US005090140A

United States Patent [19]

Sessa

[11] Patent Number: 5,090,140

[45] Date of Patent: Feb. 25, 1992

[54] FOOTWEAR WITH INTEGRATED COUNTERPOCKET SHOE HORN

[75] Inventor: Scott C. Sessa, Grand Rapids, Mich.

[73] Assignee: Wolverine World Wide, Inc., Rockford, Mich.

[21] Appl. No.: 613,300

[22] Filed: Nov. 15, 1990

Related U.S. Application Data

[63] Continuation of Ser. No. 398,881, Aug. 28, 1989.

[51] Int. Cl.[5] ..... A43B 11/02; A43B 11/00

[52] U.S. Cl. ..... 36/138; 36/68; 36/69

[58] Field of Search ..... 36/58.5, 136, 132, 50, 36/7.1 R, 68, 69, 129, 54, 138

[56] References Cited

U.S. PATENT DOCUMENTS

| | | | |
|---|---|---|---|
| 1,619 | 2/1864 | Moore . | |
| 11,387 | 12/1910 | Paterson . | |
| 14,996 | 7/1905 | Clausen . | |
| 19,521 | 10/1895 | Church . | |
| 39,893 | 3/1909 | Barna . | |
| 41,087 | 1/1864 | Moore . | |
| 88,380 | 3/1869 | Forrest . | |
| 102,940 | 5/1870 | Kilsheimer . | |
| 282,240 | 7/1883 | Thomson . | |
| 297,469 | 4/1884 | Stickney . | |
| 453,682 | 6/1891 | Walden . | |
| 500,134 | 6/1893 | James . | |
| 506,958 | 10/1893 | Walden . | |
| 553,130 | 1/1896 | Norris . | |
| 628,164 | 7/1899 | See . | |
| 647,824 | 4/1900 | Girtanner . | |
| 902,929 | 11/1909 | Telford . | |
| 913,695 | 3/1909 | Carroll . | |
| 1,176,572 | 3/1916 | Lassig . | |
| 1,213,036 | 1/1917 | Taylor . | |
| 1,342,149 | 6/1920 | Avis . | |
| 1,361,925 | 12/1920 | Thompson . | |
| 1,515,086 | 11/1924 | Baluta . | |
| 2,474,954 | 12/1946 | Nelson | 36/58 |
| 2,512,917 | 7/1948 | Buddenhagen | 36/58 |
| 3,643,350 | 2/1972 | Paoletta et al. | 36/2.5 |
| 3,810,318 | 5/1974 | Epstein | 36/2.5 |
| 4,114,297 | 9/1978 | Famolare, Jr. | 36/50 |
| 4,236,328 | 12/1980 | Friedlander | 36/58 |
| 4,287,675 | 9/1981 | Norton et al. | 36/129 |
| 4,489,509 | 12/1984 | Libit | 36/7.1 |
| 4,553,293 | 11/1985 | Blum | 24/119 |
| 4,566,207 | 1/1986 | Struntz | 36/50 |
| 4,608,769 | 9/1986 | Sturlaugson | 36/68 |
| 4,610,102 | 9/1986 | Hill | 36/136 |
| 4,766,682 | 8/1988 | Malloy, III | 36/132 |

FOREIGN PATENT DOCUMENTS

| | | |
|---|---|---|
| 155106 | 7/1938 | Fed. Rep. of Germany . |
| 2041721 | 2/1979 | United Kingdom . |

OTHER PUBLICATIONS

Journal of the AMA, Oct. 1958, p. 930.

*Primary Examiner*—Steven N. Meyers

*Attorney, Agent, or Firm*—Price, Heneveld, Cooper, DeWitt & Litton

[57] ABSTRACT

A shoe having an integral pull-on shoe horn comprising a counterpocket extending beneath and bonded at the heel portion of the insole, extending up the rear and both sides of the heel to receive the heel of a foot, and extending up beyond the peripheral rim of the shoe in the form of an elongated rear pull tab portion foldable from an upward position to a retained lower position down over the rear for fastening.

12 Claims, 2 Drawing Sheets

FOOTWEAR WITH INTEGRATED COUNTERPOCKET SHOE HORN

This is a continuation of application Ser. No. 07/398,881, filed Aug. 28, 1989.

BACKGROUND OF THE INVENTION

This invention relates to shoes, and more particularly to a shoe having a counterpocket, integral pull-on shoe horn.

Shoe horns of metal, wood or plastic have been known for many years, to assist entry of the foot into a shoe. Such devices are rigid, elongated, and curvilinear in cross section, as is well known, to enable temporary insertion beneath and behind the heel to serve as a type of ramp for the foot. While shoe horns are handy when readily available, and serve to lengthen shoe life, they are too often not at the location where shoes are replaced onto the feet. Moreover, youngsters typically do not take the time or effort to locate or use them. Rather, they simply thrust their feet into the shoes, to the detriment of the shoe counter.

Boot straps or pull tabs on children's shoes are of some help, but have shortcomings. Of course, the concept of having a bootstrap or a pull tab on shoes for ease of placing the shoe on a foot has been taught heretofore. Such a strap or tab is typically attached as by stitching or rivets to the shoe upper. Unless the shoe is made of very unusual overall construction, however, as in Epstein U.S. Pat. No. 3,810,318, the tremendous stress applied repeatedly to the pull tab or boot strap too frequently results in its pulling loose, thereby damaging the shoe as well as destroying the pull-on feature. And, although the structure of U.S. Pat. No. 3,810,318 would be expected to provide greater structural strength, the construction necessary for that shoe, designed especially for aiding children in learning to walk, is not considered particularly desirable for other types of shoes.

SUMMARY OF THE INVENTION

The present invention provides a novel shoe with a counterpocket and integral flexible pull-on shoe horn construction. The novel construction prevents it from pulling loose, while at the same time serving as a combination pull-on shoe horn prebuilt into the construction. The shoe can be made by generally conventional construction methods, using conventional machinery. The counterpocket extends beneath the heel portion of the insole and up both sides of the heel, the integral pull-on shoe horn extending upwardly to enable the pocket to be pulled up for readily placing the shoe on the foot. An upper gripping tab on the integral shoe horn can be folded down over the counter to be retained neatly at the back of the shoe by a hook and loop fastener.

DESCRIPTION OF THE PREFERRED EMBODIMENT

Figure 1:
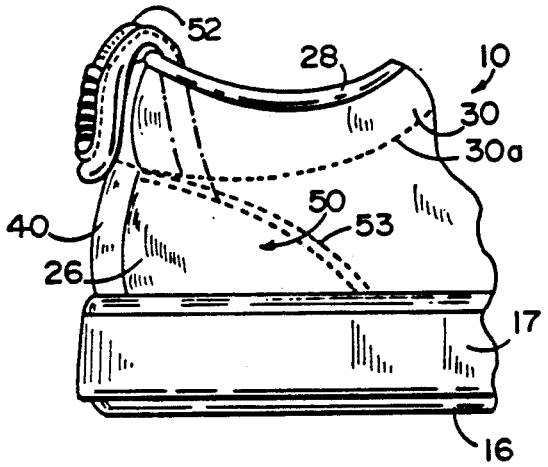
FIG. 1 is a side elevational view of the rear portion of a shoe employing this invention, showing the upper tab portion of the integral shoe horn folded down.

Referring now specifically to the drawings, the complete shoe 10 includes a sole assembly 12, and an upper 14 attached to the sole assembly. Sole assembly 12 in this embodiment is shown to include an outsole 16, an insole 18, and a partial midsole 20 in a tapered or wedge form extending beneath the heel and the arch portion of the foot. This particular sole assembly may be modified in various ways, for example, by having the midsole extend the full length of the foot in tapered or untapered form. Outsole 16 will typically be formed of a leather, rubber or rubber-like material while midsole 20 and insole 18 will typically be formed of a polymeric material such as an ethylene vinyl acetate foam.

The upper 14 is generally of conventional type including a vamp 22, a toe piece 24, and rear quarters 26, and having a foot entry opening surrounded by a peripheral rim 28. This rim may include a reinforcing collar 30 as depicted, e.g., of leather or cloth, secured to the upper by stitching 30*a*. Upper 14 is made of conventional materials such as canvas or other fabric, leather and/or polymeric materials.

The rear portion of the shoe is shown to include a conventional back stay 40, optional foam padding 42 adjacent thereto around the collar portion of the shoe, and a semirigid, reinforcing heel counter 44 as of a polymeric material such as polyvinylchloride, polyvinyl acetate or the like. This heel counter is generally horseshoe shaped to extend around the lower portion of the heel above the sole assembly, having a lower edge flange 44*a* bonded between the midsole and the outsole. The main body of counter 44 is between the quarters and a special counterpocket subassembly 50 incorporated as part of the novel shoe.

Figure 3:
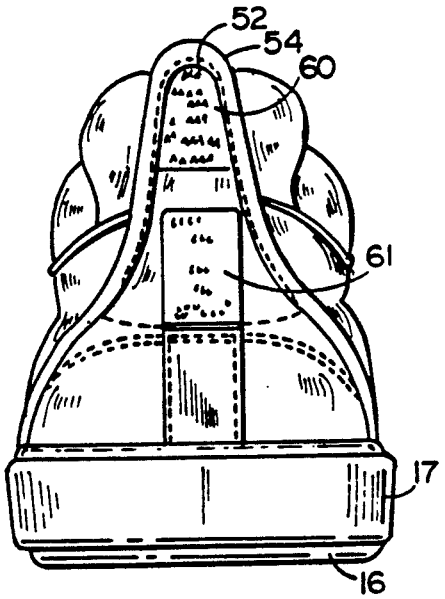
FIG. 3 is a rear elevational view of the shoe with the tab portion elevated as in FIG. 2.
Figure 2:
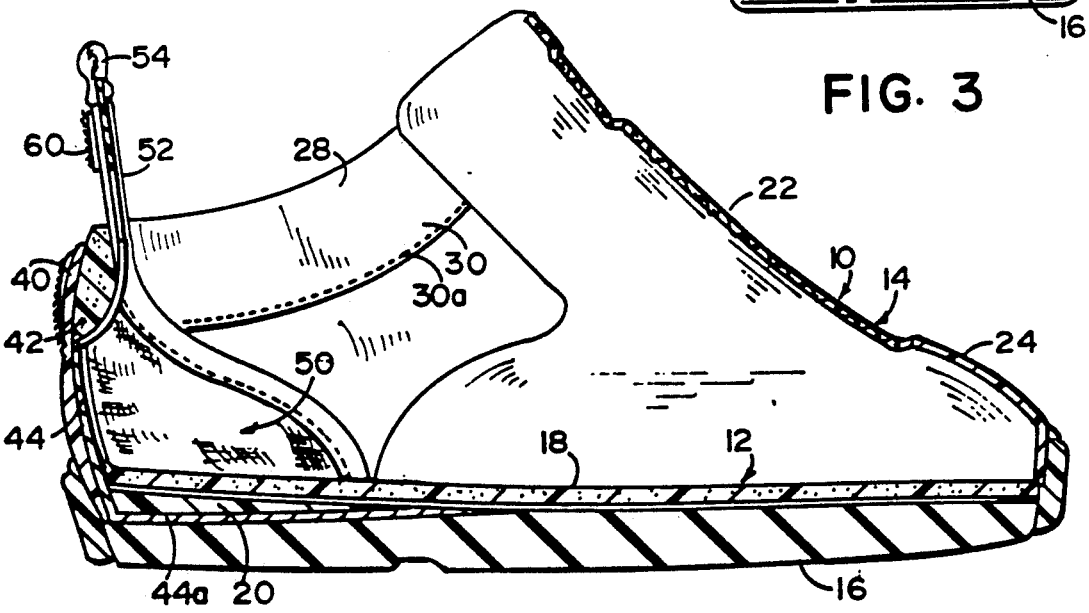
FIG. 2 is a cross sectional view of the shoe in FIG. 1 with the tab portion elevated.
Figure 4:
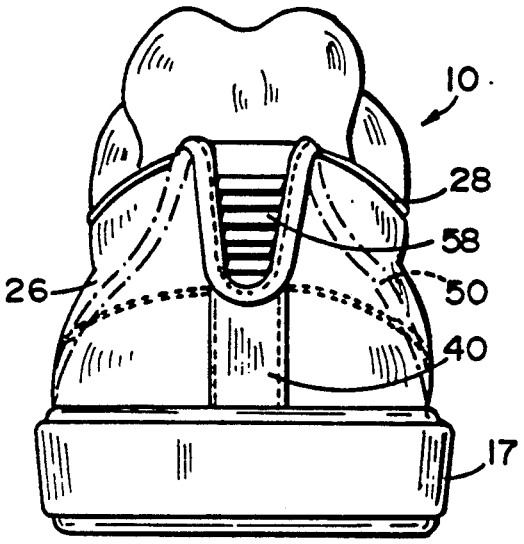
FIG. 4 is a rear elevational view of the shoe with the tab portion lowered as in FIG. 1.
Figure 5:
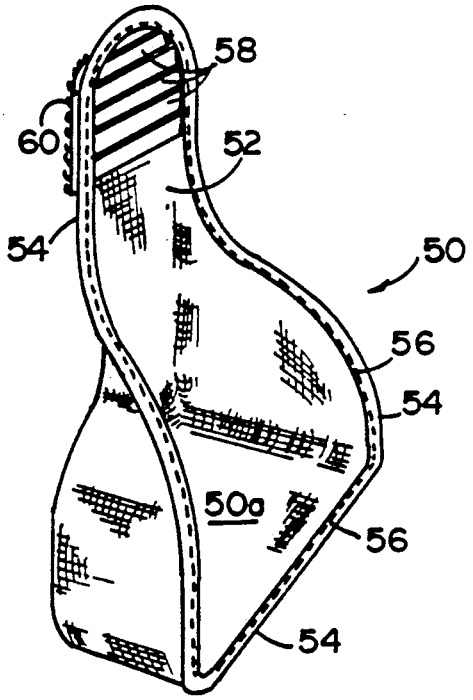
FIG. 5 is a perspective view of the counterpocket forming the shoe horn.
Figure 6:
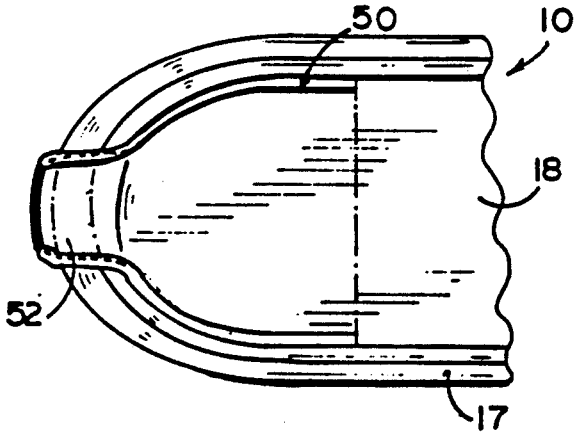
FIG. 6 is a fragmentary top plan view of the rear portion of the shoe in FIG. 1.

Counterpocket subassembly 50 is particularly depicted by itself in FIG. 5. In vertical cross section, it has a generally L-shaped configuration and is composed of a leather or fabric membrane forming a pocket made up of a portion that extends horizontally from side to side (FIGS. 5 and 6) beneath the heel portion of the insole and vertically up along the rear and both sides of the heel with the upper side edges thereof tapered upwardly-rearwardly to the top of the shoe rim, for defining a heel receiving pocket. The rear portion thereof extends vertically above this rim in the form of an elongated tab portion 52. Extending around and encompassing the edge of the periphery of this pocket, as illustrated, is a reinforcing binding 54 of U-shaped cross section, as of cloth or leather, which is stitched to the fabric by stitches 56. The counterpocket subassembly is stitched to shoe upper 14 by stitches 53 at both sides and at the rear of the quarters. This tab portion 52 may be moved between an upright position depicted in FIGS. 2, 3 and 5, and a folded down position depicted in FIGS. 1 and 6. The counterpocket membrane is flexible so as to be a comfortable component of the shoe. It has a concave curvilinear configuration in cross section horizontally across its vertical portion, so as to fit smoothly against the rear of the wearer's foot. When the user pulls up on the tab portion as the shoe is put on, the tension on the membrane tends to temporarily rigidify the membrane to enable the membrane to act like a shoe horn ramp.

The forward face of the upright tab portion has a grip surface 58 as of horizontal rubber ridges for optimum pulling grippage by the thumb. The rear face of the upright tab portion, and thus the forward face of the folded down tab portion, has one part 60 of a hook and loop fastener on its surface, e.g., a "Velcro" brand fastener, with the cooperative fastener part 61 being attached to the back stay 40. Thus, the folded down tab will cause mating of the hooks and loops to retain the tab portion in the down position until needed. The horizontal portion 50*a* of the pocket 50 that extends beneath the heel is bonded between insole 18 and midsole 20 with a suitable adhesive.

The sole assembly is secured to the upper as by stitching, adhesive bonding and/or vulcanizing. Around the juncture thereof is preferably a bumper strip 17. In use, therefore, when the shoe 10 is to be applied to a foot, tab portion 52 is pulled upwardly and rearwardly by the thumb and finger to release the hook and loop fastener and place the tab portion in upright position with the thumb on rubber grip surface 58 and the finger, usually the index finger, on fastener part 60. When the forefoot is placed in the opening defined by rim 28, the integral shoe horn is used to ramp the foot in, as well as to pull the shoe over the rear of the heel. This is done without imparting undue stress to the structure or excess friction on the individual's heel, since it forms an integral pocket that envelopes the heel and is secured between members of the sole assembly as well as the upper. After the shoe is on a foot, tab portion 52 is folded downwardly over the rim and padded collar and against the back stay of the shoe to interengage the hook and loop fastener parts.

It is conceivable that the preferred embodiment depicted may be modified in various ways without departing from the invention herein. Thus, the shoe can be a slip-on type, a lace-type, an athletic shoe, a walking shoe, or otherwise; the sole assembly can employ a different type midsole or no midsole, a sock liner inside the insole, an unpadded rim, or various other modifications well known to those in the shoemaking art. Hence, the invention is intended to be limited only by the scope of the appended claims and the reasonably equivalent structures to those defined therein, rather than to the details of the preferred embodiment illustrated.

The embodiments of the invention in which an exclusive property or privilege is claimed are defined as follows.

1. A shoe having a heel portion and an integral pull-on shoe horn comprising:

a sole assembly including at least an outsole and an insole extending beneath said shoe heel portion;

an upper attached to said sole assembly;

said upper having a foot entry opening defined by a peripheral rim;

said heel portion including quarters;

a semirigid, generally horseshoe-shaped heel counter inwardly of said quarters and extending adjacent said quarters above said sole assembly;

a counterpocket inwardly of said counter such that said counter is located between said quarters and said counterpocket, said counterpocket comprising a flexible membrane extending from side to side beneath said heel portion of said insole, and extending up the rear and both sides of said shoe heel portion and forming a heel pocket on both sides of and across the bottom of said heel portion, said membrane tending to temporarily rigidify under pulling tension to form a shoe horn, and having an elongated tab portion extending up beyond said peripheral rim;

said tab portion being foldable from an upwardly extending position to a lowered position down over the rear of said rim;

a gripping surface on the forward face of said tab portion when said tab portion is up so that pulling on said tab portion pulls on said counterpocket to enable said membrane to serve as a shoe horn as well as a pull-on aid;

a hook and loop type fastener material on the forward face of said tab portion when said tab portion is folded down; and a cooperative hook and loop type fastener material at the rear of said shoe to engage and hold said folded down tab portion.

2. The shoe in claim 1 wherein said membrane is stitched to said upper at both sides of said upper.

3. The shoe in claim 1 wherein said sole assembly includes a midsole, and the part of said counterpocket beneath said heel portion is bonded between said midsole and said insole.

4. A shoe having a forefoot portion, a heel portion and an integral pull-on shoe horn comprising:

a sole assembly including at least an outsole and an insole extending beneath the shoe heel portion;

an upper attached to said sole assembly;

said upper having a foot entry opening defined by a peripheral rim;

said heel portion including quarters;

a semirigid, generally horseshoe-shaped heel counter inwardly of said quarters and extending adjacent said quarters above said sole assembly;

a counterpocket inwardly of said counter such that said counter is located between said quarters and said counterpocket, said counterpocket extending from side to side beneath, and bonded at, the heel portion of said insole, and extending up the rear and both sides of said shoe heel portion and forming a heel pocket on both sides of and across the bottom of said heel portion, said counterpocket tending to temporarily rigidify to serve as a shoe horn when pulled in tension and to receive a heel of a foot, and extending up beyond said peripheral rim in the form of an elongated rear pull tab portion;

said pull tab portion being cooperative with said counterpocket to enable pulling of said counterpocket onto the heel of a foot while said counterpocket also functions as a shoe horn, and being foldable from an upwardly extending position to a lowered position down over the rear of said rim;

fastener means on the forward face of said tab portion when said tab portion is folded down; and cooperative fastener means on the rear of said shoe for engaging and holding said folded down tab portion.

5. A shoe having a forefoot portion, a heel portion and an integral pull-on shoe horn in said heel portion, comprising:

a sole assembly;

an upper attached to said sole assembly;

said upper having a foot entry opening defined by a peripheral rim;

said heel portion including quarters;

a semirigid, generally horseshoe-shaped heel counter inwardly of said quarters and extending adjacent said quarters above said sole assembly;

a counterpocket inwardly of said counter such that said counter is located between said quarters and said counterpocket, said counterpocket shoe horn of a flexible material having a generally L-shaped configuration having a horizontal portion extending beneath and bonded at said heel portion and extending between the two sides of said heel portion and up the rear and both sides of said heel portion to receive the heel of a foot, and extending up beyond said peripheral rim in the form of an elongated rear tab such that said counterpocket can tend to temporarily rigidify under pulling tension to serve as an integral shoe horn for ramping a foot into said shoe while pulling on said tab;

a gripping surface on said tab when said tab is up for shoe horn functioning so that pulling on said tab pulls on said counterpocket; and said tab being foldable from an upwardly extending position to a lowered position down over the rear of said rim and shoe.

6. The shoe in claim 5 including fastener means between said folded down tab and said rear of said shoe.

7. The shoe in claim 6 wherein said fastener means is of hook and loop type.

8. The shoe in claim 5 wherein said counterpocket shoe horn is stitched to said upper.

9. The shoe in claim 8 wherein said counterpocket shoe horn is of leather.

10. The shoe in claim 8 wherein said counterpocket shoe horn is of fabric.

11. The shoe in claim 5 including a binding attached to the periphery of said counterpocket shoe horn.

12. The shoe in claim 5 including an insole and wherein said horizontal portion extends beneath said insole.

* * * * *